US005185495A

United States Patent [19]

Petrovich et al.

[11] Patent Number: 5,185,495

[45] Date of Patent: Feb. 9, 1993

[54] PROJECTIVE WITH IMPROVED FLOWERING

[76] Inventors: Robert M. Petrovich, 10748 Bob White, P.O. Box 111, Hamburg, Mich. 48139; Paul A. Petrovich, 11269 Judd Rd., Fowlerville, Mich. 48836

[21] Appl. No.: 867,571

[22] Filed: Apr. 13, 1992

[51] Int. Cl.[5] ..... F42B 12/34

[52] U.S. Cl. ..... 102/510; 102/507; 102/514; 102/518

[58] Field of Search ..... 102/506-510, 102/514-519

[56] References Cited

U.S. PATENT DOCUMENTS

| | | | |
|---|---|---|---|
| 1,059,213 | 4/1913 | Ross | 102/509 |
| 1,114,356 | 10/1914 | Hoagland | 102/507 |
| 2,327,950 | 8/1943 | Whipple | 102/507 |
| 2,682,224 | 6/1954 | Braverman | 102/507 |
| 4,136,616 | 1/1979 | Schirneker | 102/510 |
| 4,949,644 | 8/1990 | Brown | 102/501 |
| 4,977,834 | 12/1990 | Denis | 102/507 |

FOREIGN PATENT DOCUMENTS

| | | | |
|---|---|---|---|
| 4426 | of 1899 | United Kingdom | 102/507 |
| 16089 | of 1900 | United Kingdom | 102/517 |

*Primary Examiner*—Harold J. Tudor

*Attorney, Agent, or Firm*—Peter A. Taucher; David L. Kuhn

[57] ABSTRACT

The invention is an improved partially jacketed projectile intended for small arms use. The projectile includes a central stem integral with a rear wall of the projectile, the rear wall in turn being integral with the partial jacket. A core surrounding the stem and encased by the jacket is softer than the material forming the stem, rear wall and jacket. The jacket retards core petalling during initial projectile impact whereas the rear wall configuration enhances petalling when the projectile achieves subsequent target penetration.

10 Claims, 1 Drawing Sheet

PROJECTIVE WITH IMPROVED FLOWERING

GOVERNMENT USE

The invention described herein may be manufactured, used and licensed by or for the U.S. Government for governmental purposes without payment to us of any royalty.

BACKGROUND AND SUMMARY

Our invention falls within the art of petalling small arms projectiles that are sometimes considered desirable for close range antipersonnel applications. We believe that initial delay of petalling relative to the rate of target penetration will increase the lethality of antipersonnel projectiles. Consequently, we have designed projectiles whose structure controllingly retards initial petalling rate.

Our improved projectile design includes an integral structure of an axial stem, a rear wall at the base of the stem and a jacket joined to the rear wall. A core surrounding the stem and partly encased by the jacket is made of softer material than the stem, rear wall and jacket. The jacket causes petalling retardation during initial stages of projectile impact wherein the core begins to break into elongate sectors. However, the rear wall is specially configured to enhance petalling motion of core sectors as a function of forward stem movement relative to these sectors, most of which movement occurs after the initial stages of projectile impact. Thus, at least some projectiles designed according to our disclosure will exhibit initial petalling retardation and subsequent petalling acceleration relative to projectile penetration rate. The cores of such projectiles will quickly widen or disperse after penetrating to relatively deeper, more vulnerable zones of the target, whereby projectile lethality is enhanced.

DETAILED DESCRIPTION

Figure 1:
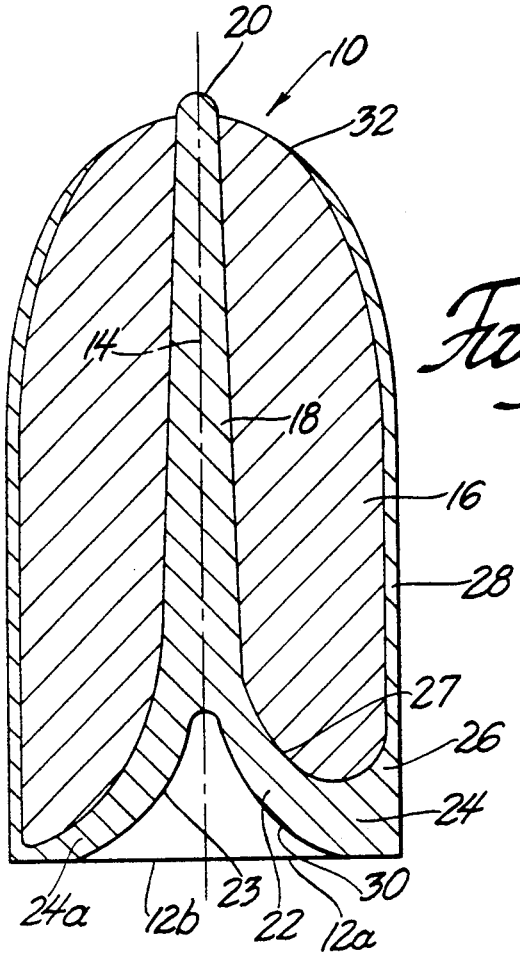
FIG. 1 is a cross sectional view showing two closely related embodiments of our projectile, one embodiment shown on the right side of the figure and the other embodiment shown on the left side of the figure.

The FIG. 1 shows two slightly different embodiments of projectile 10, the right half 12*a* of projectile rear being different from the left half 12*b* of the projectile rear. Both embodiments have an elongate tapered stem 18 along projectile axis 14, the taper preferably being such that the lateral stem surface defines an angle of 1 to 5 degrees with axis 14. The stem optionally has a straight, rod-like configuration. Stem 18 is comprised of copper, soft steel or other metal or alloy of similar malleability and hardness. Surrounding and conforming to the stem is a core 16 of metal dissimilar to and softer than the metal of the stem, the core metal typically being lead. Stem 18 may be hardened by nitriding or coating it with a heat treated plating, although wall 22 and jacket 28 will not be so hardened. A tip 20 of stem 18 protrudes forward from the body of core 16, the tip's exposed length normally being approximately 10 thousandths of an inch. Preferably, the tip is smooth and round so as to minimize potential for the projectile's nose to hang up in a gun's chambering mechanism when the projectile is loaded into the gun.

The rear 12*a* of the right-half FIG. 1 embodiment has a complexly curved wall 22 forming a cone-like structure integral with stem 18, the radially inward section of wall 22 being approximately half the diametrical width of the stem's portion to which it is joined. Wall 22 diverges or flares at its radially outward end so as to form a thickened ring-like zone 24 at the rearward end of the outer diametrical surface of projectile 10. Zone 24 has a forwardly tapered ring neck 26 that integrally merges into jacket 28. Wall 22 and stem 18 have smooth surfaces contacting the core to facilitate sliding motion between them and the core when projectile 10 hits a target. The inner, rearwardly facing surface 30 of wall 22 defines an open ended, essentially conical void at the rear of projectile 10, the void being concentric with axis 14. One effect of the void is to move the projectile's center of gravity forward, thereby increasing its stability during flight.

Similarly to rear 12*a*, the rear 12*b* of the left-half FIG. 1 embodiment has a complexly curved wall 23 forming a cone-like structure integral with stem 18. All of wall 23, except for its outer diametrical end, is approximately the same width, namely, half the diametrical width of the base of the stem. The outer peripheral edge of wall 23 narrows in the radially outward direction and forms a sharp corner with jacket 28. Wall 23 has a smooth surface contacting the core to allow sliding motion between it and the core when projectile 10 strikes a target. The inner surface 31 of wall 23 bounds an open ended conical void at concentric with axis 14 the rear of projectile 10.

Figure 3:
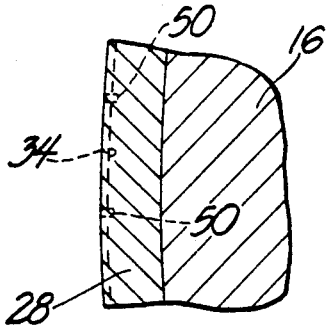
FIG. 3 is a cross sectional detail view showing scores or channelets on the jacket of the projectile.

Jacket 28 is integral with wall 22 or 23, whereby the jacket, wall and stem form a single, continuous piece. The jacket encases core 16 and preferably adjoins and covers the majority of the outer surface of the core, the portion of the outer surface covered ranging between 50% and 95%. Also preferably, the forward section of the jacket curves radially inwardly along and in front of core 16, the jacket forming a tapered lip at its forward edge 32. Optionally, circumferentially spaced longitudinal channelets or scores can be scribed on the outer surface of the jacket as seen at 34 in the FIG. 3 detail view.

In operation, when projectile 10 strikes the flesh of an intended target, tip 20 enters first to initiate tears or breaks in the skin or other cover on the target exterior. The tip thus prevents the skin or cover at the point of penetration from being punched out as a disk-like unit and then being pushed ahead by the projectile, the disk-like unit thereby potentially interfering with the projectile's intended petalling effect.

After entry of tip 20, the forward end of core 16 impacts the target and begins to deform outward as the stem continues to penetrate the target. The rate of outward core deformation relative to speed of projectile penetration is controlledly retarded by jacket 28. The minimum desired degree of desired retardation occurs when the jacket encloses 50% of the core and the maximum desired degree of retardation occurs when the jacket covers 95% of the core. Stem 18 is harder and more streamlined than the deforming core and will penetrate the target faster, whereby the stem advances relative to the core. The advancement of the stem wedges the core outward so that the forward end of the core separates from the stem and the core splits into axially elongate sectors. The sectors then peel or "petal" away from the stem in a manner similar to the motion of petals of an opening flower.

As stem 18 continues to advance relative to the core, conical wall 22 collapses inward to permit the base of projectile 10 to pass forward through the core. In the case of the right-hand embodiment of FIG. 1, a measured degree of axial and radial thickness of ring-like zone 24 will result in controlled inhibition of the collapse of conical wall 22, whereby the stem's rate of advancement relative to the core can be governed. A slower relative stem advancement increases the amount of inertia imparted by the stem to the flowering core sectors during the projectile's target penetration, whereas faster relative stem advancement increases the speed with which the stem separates from the core to achieve independent, deeper penetration. It is noted that the left-hand FIG. 1 embodiment can be regarded as showing a minimum zone thickness at wall section 24*a*, which analogously corresponds to zone 24 of the right-hand embodiment.

Again in the case of the right hand FIG. 1 embodiment, neck 26 projects axially forward and bears inwardly against the rear outer periphery of core 16. When stem 18 advances through the core and wall 22 is drawn toward axis 14, neck 26 exerts a radially inward force on the rearward ends of the core sectors. This inward force tends to rotate the rearward ends toward the axis. Consequently, the forward ends of the core sectors more readily swing away from the axis, thereby enhancing that the petalling effect of the core sectors. Such petalling enhancement can be furthered by roughened interfaces 27 between the axially forward surface of wall 22 and the axially rearward surface of core 16. Roughened interfaces increase friction between wall 22 and the core sectors so that the wall's inward movement imparts more pivoting force to the sectors, thereby further enhancing the petalling effect.

Figure 2:
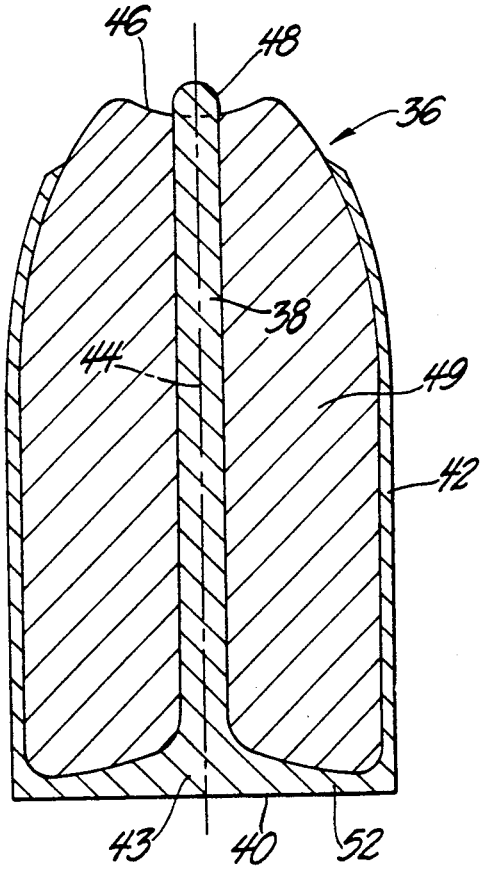
FIG. 2 is a cross sectional view of a third embodiment of our projectile.

FIG. 2 is another embodiment of our projectile 36 wherein straight cylindrical stem 38, aft wall 40 and jacket 42 are in integral, one-piece unit centered on axis 44. Wall 40 and stem 38 join at solid intersection 43, which is axially thicker than wall 40 and diametrically wider than stem 38. Projectile 36 has what is conventionally deemed a hollow point configuration in that the projectile defines a concavity 46 at the nose area of core 49. Stem tip 48, which protrudes into concavity 46, is similar in structure to tip 20 in FIG. 1. The components of projectile 36 are formed of the same materials as their counterparts in the FIG. 1 embodiments.

In operation, when projectile 36 strikes a flesh bearing target, core 49 will flatten, separate from stem 38 and be forced backward relative to the stem. Core 49 will split into longitudinal seqments and petal, the rate of petalling per unit length of target penetration being controllably retarded, the degree of retardation being a function of jacket thickness and the percentage of the projectile encased by the jacket. As core 49 is forced rearward relative to stem 38, aft wall 40 will bend backward. The bending will be differential in that the thinner, radially outward zone 52 of the wall will bend backward further and faster than the more radially inner portion of the wall. The wall's differential bending causes the core segments to swing around zone 42, thereby aiding the petalling of the segments.

All of the aforementioned embodiments may be modified by utilizing a core material that is more brittle and less hard than the material comprising the stem, rearward wall and jacket of the projectile. For example, if the FIG. 1 stem 18, wall 22 and jacket 28 are of copper, soft steel or brass, the core would be of bismuth, antimony or an alloy comprised principally of these two metals. In addition, the jackets would be scored not only with longitudinal channelets 34 (FIG. 3), but would also be scored by circumferential channelets 50. When the projectile impacts the target, both the jacket and the core fragmment into a multitude of shards, which tear through the target in relatively wide, shallow dispersal pattern. The pattern depth can be increased and the pattern width decreased both by greater jacket thickness and by enlarging the portion of the core covered by the jacket. As in the previous embodiments, the stem will achieve an essentially straight-line penetration deeper than the shards' penetration.

We wish it to be understood that we desire not to be limited to exact details of construction disclosed herein since obvious modifications will occur to those skilled in the relevant arts without departing from the spirit and scope of the following claims.

We claim:

1. A petalling projectile, comprising:

a front end;

a rear end;

a central longitudinal axis;

a core centered on the longitudinal axis;

means for allowing petalling of the core away from the axis during the core's penetration into a target, the allowing means including means for retarding petalling at initial impact of the projectile with the target;

the allowing means further including acceleration means for enhancing subsequent petalling of the core after initial target penetration by the projectile, the acceleration means including a stem extending along the axis from the front end to the rear end, the stem fixed to the core before the initial impace and axially loosening from the core after the initial target penetration, the acceleration means further including a radially inwardly deforming wall at the rear end, said stem and said rear wall formed as a single one-piece element of the same material throughout, said stem having a smooth outer surface over substantially its entire length, said stem and said rear wall being of a harder material than said core.

2. The projectile of claim 1 wherein a lateral wall of the stem forms an angle of 1 to 5 degrees with the axis.

3. The projectile of claim 1 further including a forwardly tapered ring neck integral with said rear wall.

4. The projectile of claim 1 wherein the stem has a generally straight, cylindrical configuration.

5. The projectile of claim 1 wherein the retarding means is a partial jacket surrounding the core, segments of the partial jacket folding radially outwardly after initial target penetration.

6. The projectile of claim 1 further comprising:

a curved surface at the forward end;

means for piercing the target ahead of the core, the piercing means including a terminus of the stem interrupting the curved surface so as to form a forward protrusion at the curved surface.

7. The projectile of claim 1 wherein said rear wall has a generally conically shaped surface;

a radially outer portion of the wall contacting a rear surface of the core, the radially outer portion drawn radially inward in concert with forward motion of the stem relative to the core;

the outer portion of the wall imparting a radially inward force to the body sections during penetration.

8. The projectile of claim 7 wherein:

the wall defines a generally conical void at the rear of the projectile;

the wall tapers in the radially outward, rearward direction.

9. The projectile of claim 8 wherein the core at the forward end defines a hollow point configuration.

10. The projectile of claim 7 wherein:

the wall defines a generally conical void at the rear of the projectile;

the wall diverge in the radially outward, rearward direction.

* * * * *